US005561925A

United States Patent [19]

Livesay

[11] Patent Number: 5,561,925

[45] Date of Patent: Oct. 8, 1996

[54] TOOTH ASSEMBLY AND RETAINING MECHANISM

[75] Inventor: Richard E. Livesay, Peoria, Ill.

[73] Assignee: Caterpillar Inc., Peoria, Ill.

[21] Appl. No.: 506,528

[22] Filed: Jul. 25, 1995

[51] Int. Cl.[6] ..... E02F 9/28

[52] U.S. Cl. ..... 37/455; 37/452; 37/457

[58] Field of Search ..... 37/449, 450, 451, 37/452, 453, 454, 455, 456, 457, 458; 172/713, 719, 701.3, 772, 772.5; 299/90, 91, 92

[56] References Cited

U.S. PATENT DOCUMENTS

| | | | |
|---|---|---|---|
| 2,919,506 | 1/1960 | Larsen | 37/142 |
| 3,021,627 | 2/1962 | Johns | 37/142 |
| 3,079,710 | 3/1963 | Larsen et al. | 37/142 |
| 3,410,010 | 11/1968 | Ratkowski | 37/142 |
| 4,182,058 | 1/1980 | Poncin | 37/142 |
| 4,233,761 | 11/1980 | Ryerson | 37/452 |
| 4,414,764 | 11/1983 | Johansson et al. | 37/141 |
| 4,761,900 | 8/1988 | Emrich | 37/142 |
| 4,965,945 | 10/1990 | Emrich | 37/142 |
| 5,152,088 | 10/1992 | Hahn | 37/141 |
| 5,177,886 | 1/1993 | Klett | 37/452 |
| 5,233,770 | 8/1993 | Robinson | 37/456 |
| 5,272,824 | 12/1993 | Cornelius | 37/458 |
| 5,423,138 | 6/1995 | Livesay et al. | 37/455 X |
| 5,469,648 | 11/1995 | Jones et al. | 37/455 X |

*Primary Examiner*—Terry Lee Melius
*Assistant Examiner*—Robert Pezzuto
*Attorney, Agent, or Firm*—O. Gordon Pence

[57] ABSTRACT

A tooth assembly includes a tip and an adapter, with the tip being replaceably secured to the adapter by a retaining mechanism. It is advantageous to have a tooth assembly that, due to mating load transfer surfaces between the tip and adapter, allows the effective transfer of forces from the tip directly into the adapter without creating undesired resultant forces on the retaining mechanism. In the subject arrangement, the retaining mechanism utilizes a double flex pin that eliminates the need for supplemental devices or components to retain such retaining pin. In particular, the pin is provided with a pair of protrusions defining a detent valley therebetween on one surface thereof that receives a detent protrusion provided on the nose of the adapter. The retaining pin is caused to flex in one direction by insertion through a curved passage through the tip and adapter to snugly secure the tip to the adapter and is caused to flex in a direction perpendicular to the first direction to locate the detent protrusion of the adapter in the detent valley of the pin. The force necessary to flex the pin sufficiently to allow the detent to escape from the detent valley prevents the pin from being lost during use.

9 Claims, 5 Drawing Sheets

TOOTH ASSEMBLY AND RETAINING MECHANISM

TECHNICAL FIELD

This invention relates generally to a tooth assembly and retaining mechanism therefore for retaining an earthworking implement tip to an adapter of such tooth assembly.

BACKGROUND ART

Tooth assemblies are normally provided on earthworking implements, such as loader buckets or ripper tools, to increase the digging effectiveness of the earthworking implement. Such tooth assemblies typically include an adapter secured to the implement and a replaceable tip mounted on the adapter and secured thereto by a retaining mechanism. In most cases, the adapter has a nose portion received within a mating socket in the rear of the tip. A pin or some other type of retaining mechanism is typically employed to replaceably secure the tip onto the nose portion of the adapter. Such pin is usually received through aligned holes in the walls of the tip socket and in the nose portion of the adapter. Digging forces acting on the tip during use must be transferred from the tip into the adapter. It is advantageous to transfer these forces in a manner that does not require the pin or retaining mechanism to resist such forces in order to prevent the breakage of such retaining mechanism. In the past, retaining mechanisms have utilized separate spring biased detent pins or rubber components to prevent the loss of the pin during use.

Such prior arrangements not only add to the complexity of the retaining mechanism, but are prone to premature failures.

The present invention is directed to overcoming one or more of the problems as set forth above.

DISCLOSURE OF THE INVENTION

In one aspect of the present invention, a tooth assembly having a forwardly and rearwardly extending longitudinal axis is provided with a tip having a rearwardly opening socket formed therein. The socket is defined by walls including a top wall, a bottom wall, and a side wall interconnected between the top and bottom walls. A first shaped opening is formed through the top wall and a second shaped opening formed through the bottom wall. The first and second openings are generally aligned with one another and located adjacent the side wall. A tip adapter has a forwardly extending nose portion adapted to be received within the socket of the tip. The nose portion has a side positionable adjacent the side wall of the tip and a shaped groove along the side. The groove has an upper end positionable in registry with the first shaped opening of the tip and a lower end positionable in registry with the second opening of the tip and a mid portion generally offset rearwardly from upper and lower ends. A tip retaining mechanism includes a dual flex pin and a detent mechanism. The pin has an elongated body of an elastically deformable spring steel material. The body has a first end portion, an opposite second end portion and a mid portion. The pin is adapted to be received within one of the shaped openings of the tip and driven through the groove in the adapter into the other of the shaped openings to an assembled position, wherein the pin is caused to be bowed rearwardly in the direction of the longitudinal axis by its passage through the rearwardly offset mid portion of the groove, and the detent mechanism is operative in a direction transverse to the longitudinal axis and includes a fixed detent projection on the tip and a detent catch on the mid portion of the pin. The detent projection is adapted for receipt within the detent catch when the pin is in its assembled position, it being necessary to deflect the pin in a direction transverse to the longitudinal axis to engage the detent projection with the detent catch of the pin or to disengage the detent projection therefrom.

BEST MODE FOR CARRYING OUT THE INVENTION

Figure 1:
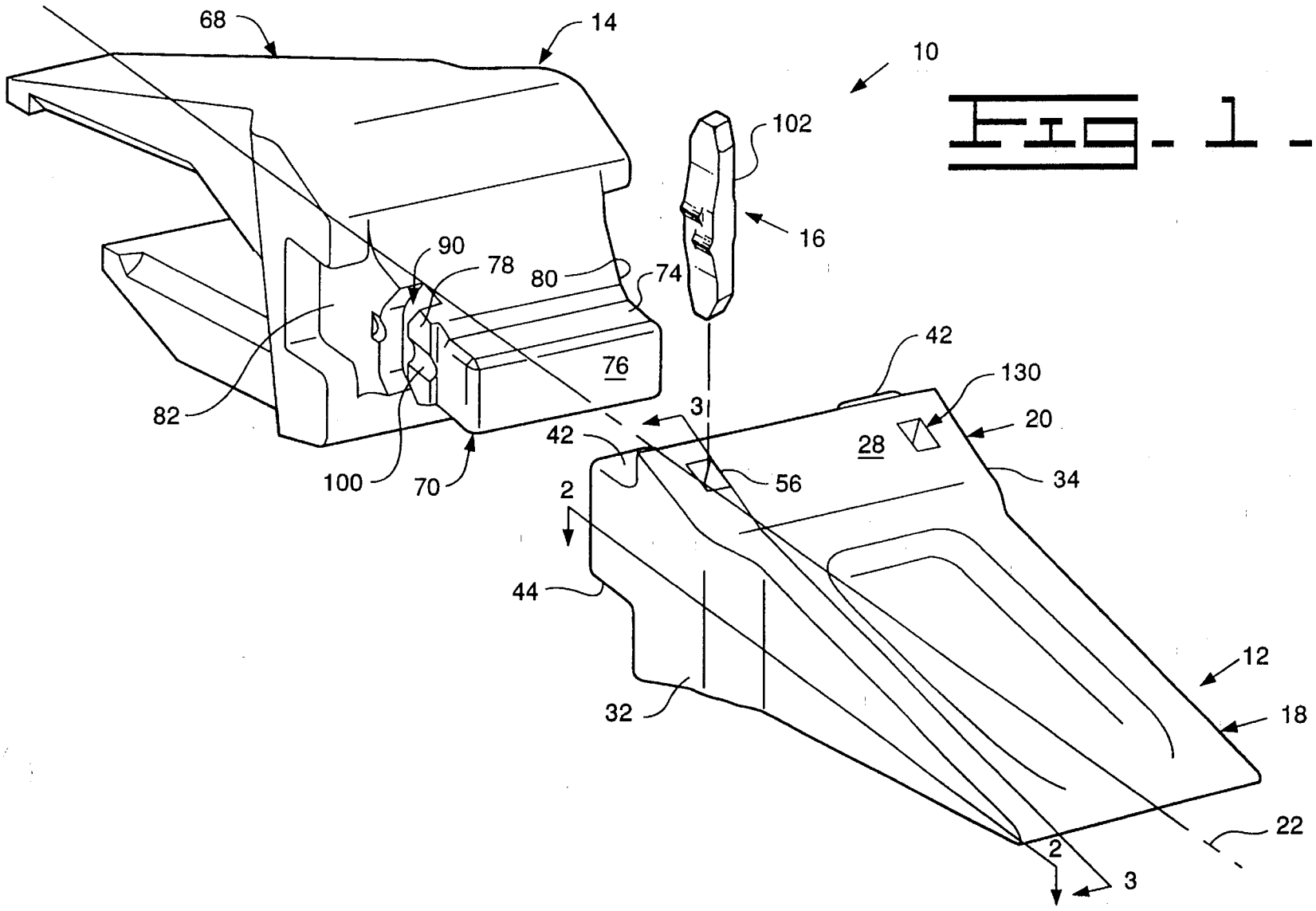
FIG. 1 is a diagrammatic exploded perspective representation of a tooth assembly illustrating the features of the present invention.
Figure 2:
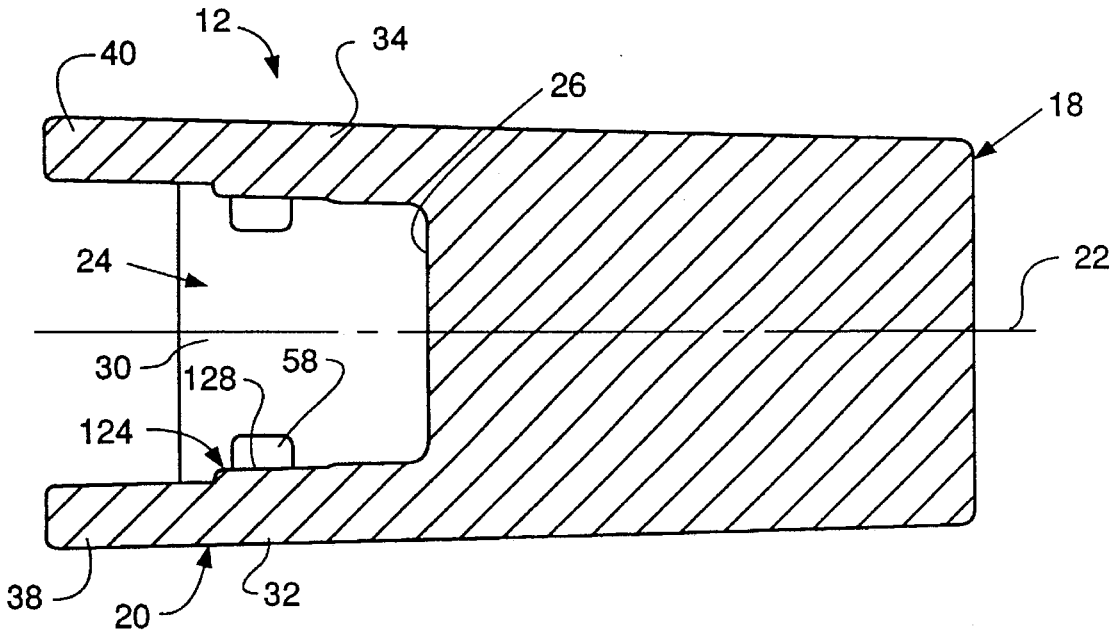
FIG. 2 is a cross-sectional view of the tip of the tooth assembly in FIG. 1 taken generally along the line 2—2 of FIG. 1.
Figure 3:
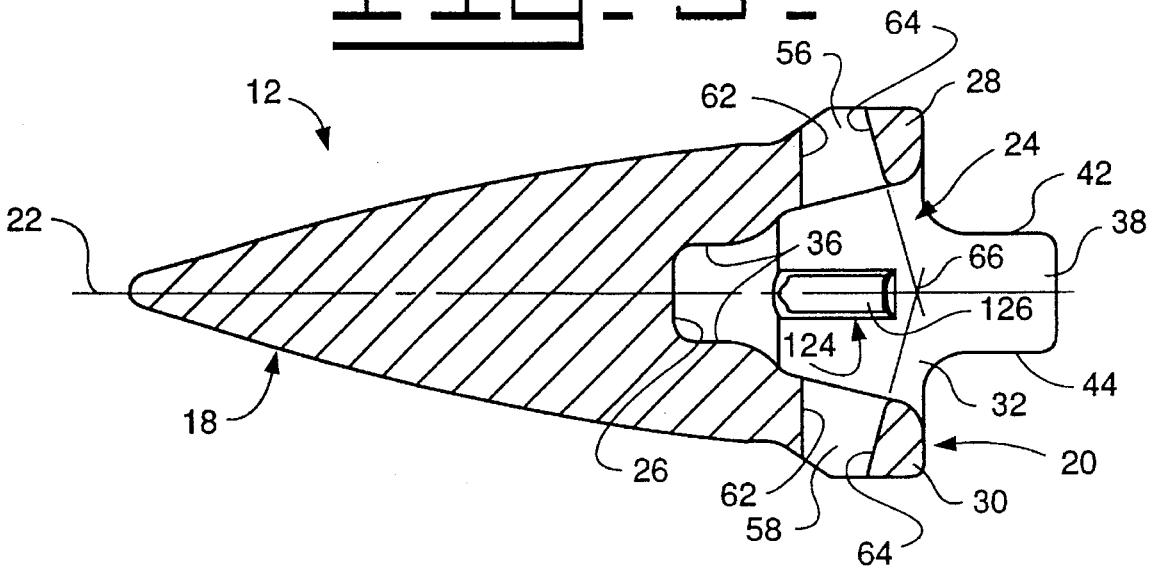
FIG. 3 is a cross-sectional view of the tip of FIG. 1 taken generally along the line 3—3 of FIG. 1.

Referring to the drawings and more particularly to FIGS. 1, 2 and 3, a tooth assembly 10 is illustrated and adapted for mounting to an earthworking implement (not shown), such as a loader bucket or ripper tool. The tooth assembly 10 includes a tip 12, an adapter 14 and a retaining mechanism 16. The tip 12 has a forward end portion 18 operative to engage the material being worked and a rearward mounting portion 20 adapted to connect the tip 12 to the adapter 14. The tooth assembly 10 has a forwardly and rearwardly extending longitudinal axis 22 along which the tip 12 and adapter 14 are disposed.

As best shown in FIGS. 2 and 3, a rearwardly opening socket 24 is defined in the rearward mounting portion 20 of the tip 12. The socket 24 is defined by a top wall 28, a bottom wall 30, a pair of side walls 32,34 and a load bearing bottom surface 26. Externally, the top and bottom walls 28,30 are angled toward and blend with the tapered forward end portion 18 to provide the tip 12 with a wedge shaped configuration. Internally, the inner surfaces of the top and bottom walls end with a pair of parallel spaced apart load bearing surfaces 36, which are disposed in the socket between the pair of sidewalls 32,34 and adjacent the load bearing bottom surface 26. Each side wall 32,34 has a rearwardly extending ear 38,40, respectively, each of which has top and bottom load bearing surfaces 42,44.

Figure 4:
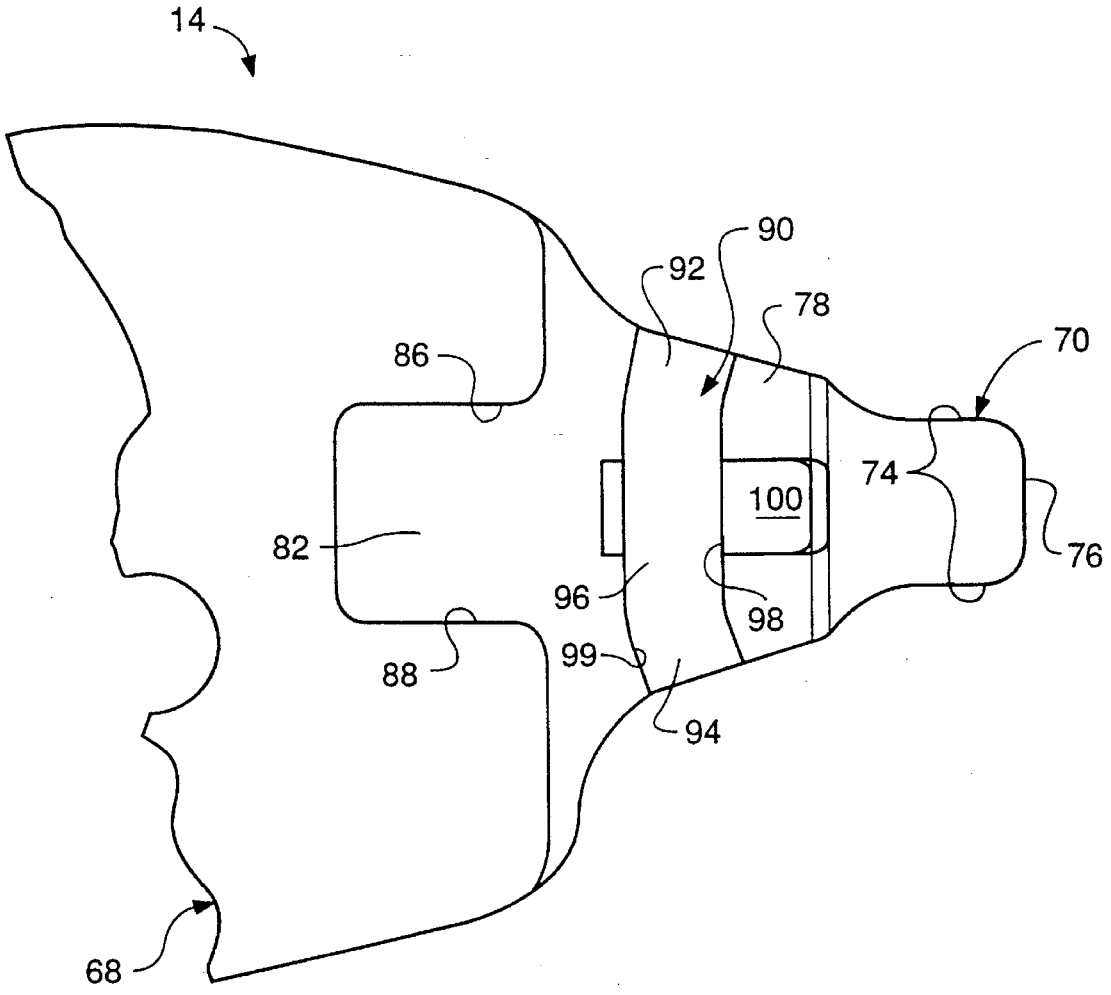
FIG. 4 is a fragmentary side elevational view of the adapter of the tooth assembly illustrated in FIG. 1.

Referring to FIGS. 1 and 4, the adapter 14 has a rearward implement mounting portion 68 and a forwardly extending nose portion 70. The nose portion 70 is configured to mate with the socket 24 of the tip 12 and includes a pair of parallel spaced apart transverse surfaces 74 interconnected by a generally flat end surface 76. The nose portion 70 also includes a pair of sides 78,80. The sides 78,80 each terminate with one of a pair of recesses 82,84 (FIG. 5) for receiving the ears 38,40 respectively, of the side walls 32,34 of the tip. Each of the recesses 82,84 has upper and lower load bearing surfaces 86,88 adapted for load bearing contact with the respective top and bottom load bearing surfaces 42,44 of the ears 38,40.

The retaining mechanism 16 includes a dual flex pin 102, first and second pin receiving openings 56,58 in the tip 12, a generally vertically oriented and shaped pin slot 90 in the nose portion 70 of the adapter 14, and a detent mechanism 72.

Figure 7:
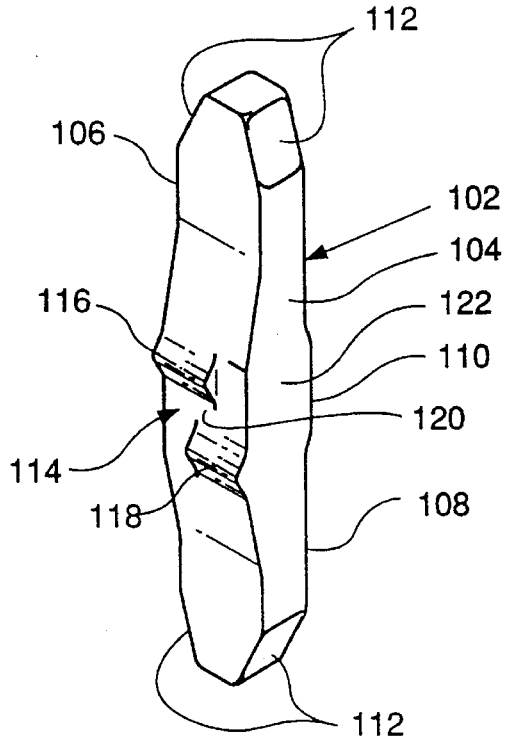
FIG. 7 is an enlarged perspective elevational view of a pin of the retaining mechanism illustrated in FIG. 1.
Figure 8:
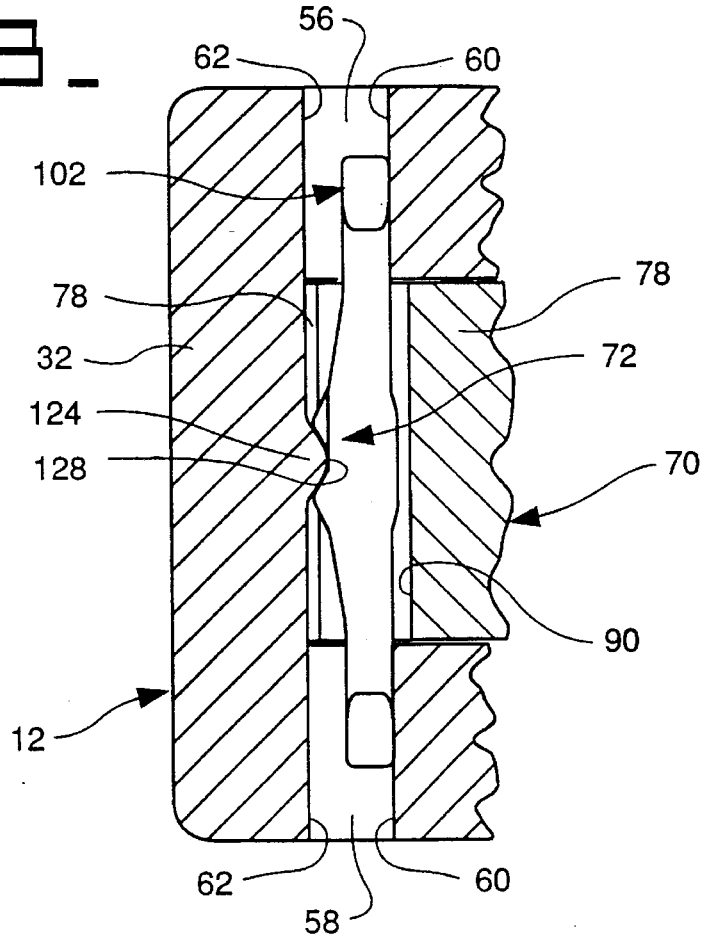
FIG. 8 is a cross-sectional view taken generally along line 8—8 of FIG. 6.

Referring to FIGS. 7 and 8, the dual flex pin 102 has an elongated body 104. The body 104 has a first end portion 106, an opposite second end portion 108 and a mid portion 110. Each end portion 106,108 has opposite tapered side surfaces 112. The mid portion 110 tapers to an increased thickness at its center where a detent catch 114 is provided. Detent catch 114 forms a portion of the detent mechanism 72 and preferably includes a pair of longitudinally spaced, transversely extending ribs 116,118 that project outwardly from one side of the elongated body 104. Such ribs 116,118 are preferably constructed with sloped sides and a rounded apex and define a detent valley 120 therebetween. The ribs may extend completely across the width of the body, but as shown in FIG. 7, the ribs 116,118 extend only part way across the width of the body of the pin in a staggered relationship to each other. It has been found that this staggered configuration reduces stresses in the pin during bending, as will hereinafter be more fully described. The mid portion also has a load bearing side surface 122.

As best shown in FIG. 3, the first pin receiving opening 56 is disposed through the top wall 28 and the second pin receiving opening 58 is disposed through the bottom wall 30. Each pin receiving opening 56,58 has a generally rectangular cross-section with substantially parallel inner and outer sides 60,61 (FIG. 8), but with front and rear ends 62,64 that are slightly angled relative to each other. In particular, the front ends 62 of the openings are generally vertical as shown in the drawings and in general alignment with each other. The rear ends 64, on the other hand, are angled relative to each other at a very obtuse angle with an apex 66 thereof being located generally along the longitudinal axis 22 of the tip 12 rearwardly of the openings. The rear ends 64 serve as load bearing surfaces and are shown in the drawings as being straight, but may be curved as well.

As best shown in FIG. 4, the vertically oriented and shaped pin slot 90 in the adapter 14 is defined in the one side 78 of the nose portion 70. Pin slot 90 has a generally rectangular cross-sectional configuration, but is bowed rearwardly. In particular, the slot 90 has an upper end portion 92 that is positionable in registry with the first pin opening 56 of the tip 12 and a lower end portion 94 that is positionable in registry with the second pin opening 58 when the tip 12 is assembled onto the adapter 14. The upper and lower end portions 92,94 extend rearwardly to a center portion 96 that is offset rearwardly from the first and second pin openings 56,58. In FIG. 4, the sides of the slot 90 are showed as being constructed of interconnected straight segments. However, the such sides could be constructed from either a continuously curved or segmented curved surfaces as well. In either case, the central portion 96 of the slot defines a forward pin contacting surface 98. The one side 78 of the nose portion also includes a generally horizontally oriented clearance groove 100 that intersects with the slot 90.

The detent mechanism 72 also includes a fixed detent projection 124. As best shown in FIG. 3, detent projection is preferably provided by a longitudinally extending rib 126 formed on and projecting inwardly from the side wall 32 of the socket 24. The rib 126 is generally equidistant from the top and bottom walls 28,30 and is provided with a height to place its distal end 128 (FIG. 8) at a position inboard of the aligned outer side surfaces 62 and outboard of the inner side surfaces 60 of the first and second pin openings 56,58.

Figure 5:
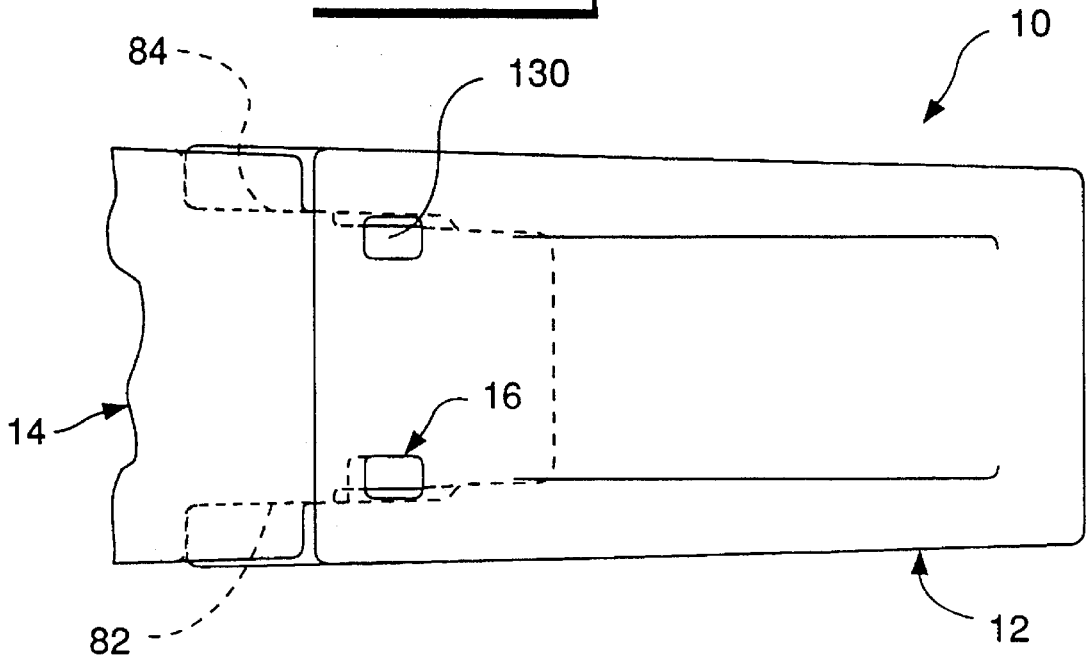
FIG. 5 is a top elevational view of the tooth assembly, but with the components thereof in their respective assembled positions.
Figure 6:
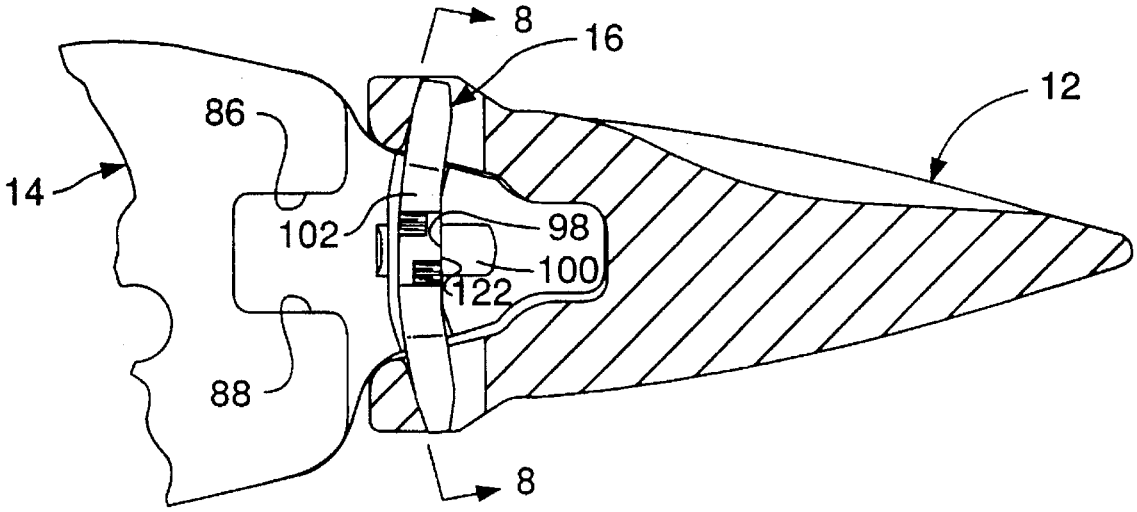
FIG. 6 is a side elevational view of the tooth assembly of FIG. 5, but with portions broken away to better show the retaining mechanism of the present invention.

Referring to FIGS. 5 and 6, the tip 12, the adapter 14, and the retaining mechanism 16 are illustrated in their assembled positions. When assembled, the ears 38,40 of the tip 12 are received in the recesses 82,84 of the adapter 14 and the pair of parallel spaced apart load bearing surfaces 36 on the tip 12 are adapted to make mating contact with the pair of parallel spaced apart transverse surfaces 74 on the adapter 14. Likewise, the top and bottom load bearing surfaces 42,44 of the ears 38,40 are adapted for load bearing contact with the respective upper and lower load bearing surfaces 86,88 within the recesses 82,84.

The pin 102 is disposed in the pin receiving openings 56,58 and through the pin slot 90 of the adapter 14. In its initial form, the pin 102 is essential straight, while in its installed position, the pin is forced to flex or bow rearwardly in view of the bowed passage in which it is disposed. The pin 102 is constructed of a suitable elastically deformable material, such as spring steel, to force the tip 12 to a position such that the load bearing bottom surface 26 of the tip 12 is in intimate contact with the generally flat end surface 76 of the nose portion 70. With the pin 102 in its installed position as illustrated in FIG. 8, the detent projection 124 along the inside of the tip side wall 32 is nested within the detent valley 120 of the pin 102. The clearance groove 100 in the adapter nose portion 70 is constructed to receive the detent projection 124 when the tip 12 is mounted onto the adapter 14.

In order to make the tip 12 reversible so as to extend its useful wear life, a second set of pin receiving openings 130 may be provided on the side of the tip 12 opposite the first and second pin receiving openings 56,58. A second groove (not shown, but similar to groove 100) may be provided on the opposite side of the adapter nose portion 70.

It should be recognized by those skilled in the art that various forms of the tooth assembly could be utilized without departing from the essence of the invention. For example, the pin 102 could have other cross-sectional shapes such as round or other multi-sided configurations. Mating configurations could be provided for the pin receiving openings 56,58 and the pin slot 90 as well.

INDUSTRIAL APPLICABILITY

The construction of the present invention is effective in providing a tooth assembly 10 in which the tip 12 is replaceably but securely retained on an adapter 14 solely by the use of a pin 102, without the need for other components to maintain the pin in place, thus eliminating premature failures caused by such additional components and reducing the complexity and cost of the prior retaining mechanisms.

To assemble the tooth assembly 10, the tip 12 is placed on the nose portion 70 of the adapter 14, with the load bearing bottom surface 26 of the tip 12 in contact with the generally flat end surface 76 of the adapter 14. The pin 102, with the detent catch 114 facing outward, is then inserted into the top pin receiving opening 56. Upon applying an external force to the pin 102, the pin 102 is driven through the slot 90 in the side of the nose portion 70 and is forced to flex rearwardly in the direction of the longitudinal axis 22 upon its engagement with the tapered surface 112 of the lower pin receiving opening 58. After the pin 102 has entered the lower pin receiving opening 58, lower rib 118 on the pin 102 will engage the detent projection 124. As the pin 102 is driven further into the lower pin opening 58, the pin 102 is forced to flex in a direction transverse to the longitudinal axis 22 as well. Once rib 118 passes the detent projection 124, the detent projection becomes seated in the detent valley 120 and the pin flexure in the transverse direction ceases and the pin is allowed to restraighten.

With the protuberance of the tip nested in the detent valley, the spring force of the pin prevents the pin from becoming dislodged unless a sufficient force is applied to the end of the pin to cause the pin to flex in the transverse direction and to drive the pin out with the same force used to drive the pin in the first instance.

With the pin 102 in its fully assembled position as illustrated, the spring force of the pin by being flexed in the longitudinal direction is operative to maintain the side surface 122 of its mid portion 110 in intimate contact with the pin contacting surface 98 of the slot 90 of the adapter 14, and the opposite tapered side surfaces 112 of the first and second pin end portions 106,108 in intimate contact with the angled rear ends 64 of the top and bottom pin openings 56,58 in the tip 12. The spring force exerted by the pin 102 is effective in maintaining the load bearing bottom surface 26 in tight engagement against the generally flat end surface 76. This forced contact eliminates unwanted looseness of the tip 12 on the adapter 14. While the spring force of the pin 102 is operative in the longitudinal direction of the axis 22 to retain the tip 12, the spring force of the pin is operative in a transverse direction of the axis 22 for purposes of detent mechanism 72 to prevent the loss of the pin 102 during operation.

During such operation, any forces acting directly on the front of the forward end portion 18 of the tip 12 is transferred through the load bearing bottom surface 26 directly to the generally flat end surface 76 of the adapter 14. Any downward force acting on the forward end portion 18 of the tip 12 is transmitted from the top one of the pair of parallel spaced apart load bearing surfaces 36 to the top one of the pair of parallel spaced apart transverse surfaces 74 of the adapter 14. The reaction force is taken by the top load bearing surface 42 of the ear 38 contacting the upper load bearing surface 86 in the recess 82 of the adapter 14. This provides a positive force transfer from the tip 12 to the adapter 14 without having a resultant force acting to move the tip 12 away from the adapter 14. Likewise, any upward force acting on the forward portion 18 of the tip 12 is transferred to the adapter 14 through the contact of the lower one of the parallel spaced apart load bearing surfaces 36 contacting the lower one of the pair of parallel spaced apart transverse surfaces 74. The reaction force is taken by the contact between the bottom load bearing surface 44 of the ear 38 and the lower load bearing surface 86 of the adapter 14.

In view of the foregoing, it is readily apparent that the structure of the present invention provides a tooth assembly 10 with a retaining mechanism that retains the tip 12 on the adapter 14 of the tooth assembly 10 without the use of separate components that might fail and allow the tip 12 to become separated from the adapter 14.

Other aspects, objects, and advantages of this invention can be obtained through a study of the drawings, the disclosure and the appended claims.

I claim:

1. A tooth assembly having a forwardly and rearwardly extending longitudinal axis, comprising:

a tip having a rearwardly opening socket formed therein, said socket being defined by walls including a top wall, a bottom wall, and a side wall interconnected between said top and bottom walls, and including a first pin receiving opening formed through said top wall and a second pin receiving opening formed through said bottom wall, said first and second openings being generally aligned with one another and located adjacent said side wall;

a tip adapter having a forwardly extending nose portion adapted to be received within said socket of the tip, said nose portion having a side positionable adjacent said side wall of the tip and a shaped pin slot along said side, said pin slot having an upper end portion positionable in registry with said first pin receiving opening of the tip and a lower end portion positionable in registry with said second opening of the tip and a center portion generally offset rearwardly from said first and second pin receiving openings; and a tip retaining mechanism including a dual flex pin and a detent mechanism, said pin having an elongated body of an elastically deformable spring steel material, said body having a first end portion, an opposite second end portion and a mid portion, said pin being adapted to be received within one of said pin receiving openings of said tip and driven through said pin slot in the adapter into the other of said pin receiving openings to an assembled position, wherein said pin is caused to be bowed rearwardly in the direction of said longitudinal axis by the pin's passage through said rearwardly offset center portion of said pin slot, and said detent mechanism being operative in a direction transverse to said longitudinal axis and includes a fixed detent projection on one of said tip and pin and a detent catch on the other of said tip and pin, said detent projection being adapted for receipt within said detent catch when said pin is in said pin's assembled position, and said detent projection and said detent catch being of a construction to cause said pin to be elastically flexed in a direction transverse to said longitudinal axis in order to engage said detent projection within said detent catch and to disengage said detent projection from said detent catch.

2. The tooth assembly of claim 1 wherein said detent catch is provided on said pin and includes a pair of transversely extending ribs that project outwardly from one side of said pin and define a detent valley therebetween.

3. The tooth assembly of claim 2 wherein said first and second pin receiving openings of the tip have aligned inner and outer sides and wherein said detent projection of the detent mechanism includes a longitudinally extending rib formed on the side wall of said socket at a location generally equidistant from said top and bottom walls, said rib being of a height to place its distal end at a position inboard of the aligned outer side and outboard of the inner side of the openings.

4. The tooth assembly of claim 3 wherein said socket of the tip includes a pair of sidewalls, a load bearing bottom surface is located at the bottom of the socket and a pair of parallel spaced apart load bearing surfaces are located in the socket between the pair of sidewalls and adjacent the load bearing bottom surface in the socket.

5. The tooth assembly of claim 4 wherein said tip includes a rearwardly extending ear projecting from each of said sidewalls, each ear having a top and bottom load bearing surface thereon.

6. The tooth assembly of claim 5 wherein said nose portion of the adapter has a pair of parallel spaced apart transverse surfaces that matingly engage the parallel spaced apart load bearing surfaces in the socket of the tip, and a generally flat end surface operative to mate with the bottom surface of the socket in the tip.

7. The tooth assembly of claim 6 wherein the nose portion of the adapter has a recess defined in each side thereof, each recess being operative to receive a respective one of the rearwardly extending ears of the socket sidewalls, each recess having upper and lower load bearing surfaces operative to mate with the respective top and bottom load bearing surfaces of the rearwardly extending ears.

8. A retaining mechanism for retaining a tip onto an adapter of a tooth assembly, said tooth assembly having a forwardly and rearwardly extending longitudinal axis and said tip having a fixed detent projection projecting inwardly in a direction transverse to said longitudinal axis, comprising:

a dual flex pin having an elongated body of an elastically deformable spring steel material, said body being adapted to be bowed rearwardly in the direction of said longitudinal axis to provide a biasing force sufficient to snugly attach said tip to said adapter, and said body having a detent catch formed thereon, said detent catch being operative in a direction transverse to said longitudinal axis and located to receive said detent projection of the tooth assembly, said pin being adapted to flex and provide a biasing force in a direction transverse to said longitudinal axis sufficient to maintain the engagement of said detent projection within said detent catch.

9. A tip for mounting on an adapter of a tooth assembly, the tip being adapted for use with a dual flex pin for retaining the tip onto a forward nose of said adapter, comprising:

a forward portion operative to engage the material being worked; and a rearward mounting portion having a rearwardly opening socket therein defined by surrounding walls including a top wall, a bottom wall, and a pair of sidewalls, said sidewalls each having a rearwardly extending ear projecting therefrom, said top wall having a first pin receiving opening therethrough, and said bottom wall having a second pin receiving opening therethrough, each of said first and second openings being located proximate to one of said side walls, said openings having aligned front ends, aligned inner and outer sides and canted rear ends, said canted rear ends being angled relative to each other at an obtuse angle having an apex located rearwardly of the openings, and said sidewall proximate said openings having detent projection projecting inwardly into said socket, said detent projection being located midway between said openings and having a distal end located at a position inboard of the outer sides and outboard of the inner sides of said openings.

* * * * *